US009816171B2

(12) United States Patent
Pham et al.

(10) Patent No.: US 9,816,171 B2
(45) Date of Patent: Nov. 14, 2017

(54) BORONIZING COMPOSITION AND METHOD FOR SURFACE TREATMENT OF STEELS

(71) Applicant: Siemens Aktiengesellschaft, Munich (DE)

(72) Inventors: Gia Khanh Pham, Charlotte, NC (US); David S. Segletes, York, SC (US); Steffan Walter, Oberpframmern (DE); Niels Van der Laag, München (DE)

(73) Assignee: Siemens Aktiengesellschaft, Munich (DE)

( * ) Notice: Subject to any disclaimer, the term of this patent is extended or adjusted under 35 U.S.C. 154(b) by 298 days.

(21) Appl. No.: 14/178,396

(22) Filed: Feb. 12, 2014

(65) Prior Publication Data

US 2015/0225834 A1 Aug. 13, 2015

(51) Int. Cl.

| | |
|---|---|
| ***C23C 8/68*** | (2006.01) |
| ***C23C 8/70*** | (2006.01) |
| ***C23C 8/42*** | (2006.01) |
| ***C23C 8/80*** | (2006.01) |

(52) U.S. Cl.

CPC ..... *C23C 8/42* (2013.01); *C23C 8/68* (2013.01); *C23C 8/70* (2013.01); *C23C 8/80* (2013.01)

(58) Field of Classification Search

CPC ..... C23C 8/68; C23C 8/70

USPC ..... 148/247

See application file for complete search history.

(56) References Cited

U.S. PATENT DOCUMENTS

| | | | | |
|---|---|---|---|---|
| 4,398,968 | A | 8/1983 | Koyama | |
| 2002/0092585 | A1 | 7/2002 | Savich | |
| 2013/0243955 | A1* | 9/2013 | Carlisle | C23C 16/448 427/248.1 |

FOREIGN PATENT DOCUMENTS

| | | | | |
|---|---|---|---|---|
| CN | 102874794 | * | 1/2013 | C01B 31/02 |
| DE | 2208734 | A1 | 8/1973 | |
| EP | 0161761 | A2 | 11/1985 | |
| SU | 535374 | * | 1/1977 | C23C 9/10 |

OTHER PUBLICATIONS

PCT International Search Report dated Apr. 22, 2015 corresponding to PCT International Application No. PCT/US2015/015100 filed Feb. 10, 2015 (13 pages).

Yu L G et al: "FeB/Fe2B phase transformation during SPS pack-boriding: Boride layer growth kinetics", Acta Materialia, vol. 53, No. 8, Mar. 8, 2005, pp. 2361-2368, XP027685305; 2005.

* cited by examiner

*Primary Examiner* — Lois Zheng

(57) ABSTRACT

Disclosed are new boronizing compositions consisting of boron fluoride and boron oxide, borax, or an iron boride. The compositions reduce the heating temperature and time. Further disclosed are methods of boronizing a metal substrate including these compositions, or any combination thereof.

10 Claims, No Drawings

BORONIZING COMPOSITION AND METHOD FOR SURFACE TREATMENT OF STEELS

TECHNICAL FIELD

The disclosed technology relates to boronizing compositions and methods technologies used to surface treat metal substrates.

BACKGROUND

Boronizing technology is currently utilized for surface treatment of metal substrates. Boronization of metal substrates provides enhanced properties of the metal substrate, such as increased hardness, high wear, erosion and corrosion resistance, high fatigue life, good oxidation resistance, and others. Chemical vapor deposition, physical vapor deposition, pack boronizing, paste boronizing, liquid boronizing, gas boronizing, plasma boronizing, and fluidized bed boronizing are examples of conventional boronizing technologies. Current boronization techniques require high temperatures and long processing times. These conditions lead to a degradation of mechanical properties of metal substrates, requiring a post-heat treatment of the boronized metal substrates. The result is inflexible boronization and high cost for the multi-step treatment process.

A simple, cost-effective boronization process that provides the enhanced properties of the metal substrate at lower temperatures, reduced time, and without the additional post-heat treatment would be beneficial, as would reagents and compositions to employ such processes.

SUMMARY

In some embodiments, a boronizing composition may include at least one boron fluoride, or molten salts thereof, and one or more of a boron oxide, borax, or an iron boride. The boron fluoride may be any of sodium tetrafluoroborate, potassium tetrafluoroborate, sodium tetrafluoroborate-potassium fluoride, potassium tetrafluoroborate-potassium fluoride, lithium tetrafluoroborate, magnesium tetrafluoroborate, strontium borofluoride, barium borofuoride, or a combination thereof. The boron oxide may be diboron trioxide ($B_2O_3$). The iron boride may be FeB, $Fe_2B$, or combinations thereof.

In some embodiments, a method of boronizing a metal substrate may include contacting a metal substrate with a boron composition including at least one boron fluoride and one or more of a boron oxide, borax, or an iron boride, heating the boron composition and metal substrate to at least 380° C., for at least one hour, and interacting the boron composition with the metal substrate, wherein a boron layer is created.

In some embodiments, a method of boronizing a metal substrate may include contacting a metal substrate with a boron composition comprising at least one boron fluoride and one or more of a boron oxide, borax, or an iron boride, heating the boron composition and metal substrate to at least 380° C., under pressure, for at least one hour, applying an electric current simultaneously while heating the boron composition and metal substrate, and interacting the boron composition with the metal substrate, wherein a boron layer is created.

DETAILED DESCRIPTION

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

The following terms shall have, for the purposes of this application, the respective meanings set forth below.

"Optional" or "optionally" means that the subsequently described event or circumstance may or may not occur, and that the description includes instances where the event occurs and instances where it does not.

"Substantially no" means that the subsequently described event may occur at most about less than 10% of the time or the subsequently described component may be at most about less than 10% of the total composition, in some embodiments, and in others, at most about less than 5%, and in still others at most about less than 1%.

The term "boronizing" as used herein refers to any surface hardening process where boron atoms are diffused into a surface.

The term "boron layer" as used herein refers to any surface layer on a boronized metal substrate.

The term "molten salt" as used herein refers to any salt or mixture of salts which is in the liquid phase. For example, sodium chloride is a molten salt when heated to 801° C., where sodium chloride would melt into a liquid.

The term "activator" as used herein refers to any substance that is used to make a compound active or increase the activity of a compound.

The term "binder" as used herein refers to any substance that is used to make a compound attach or increase the attachment of a compound to another compound or a substrate.

The term "bed material" as used herein refers to any substance that is used to provide stability and/or support in the boronization process. The bed materials do not participate in the chemical reactions.

In some embodiments, a boronizing composition may include at least one boron fluoride, or molten salts thereof, and one or more of a boron oxide, borax, or an iron boride.

The boron fluoride may be lithium tetrafluoroborate ($LiBF_4$), sodium tetrafluoroborate ($NaBF_4$), potassium tetrafluoroborate ($KBF_4$), magnesium tetrafluoroborate ($MgBF_4$), strontium borofluoride ($SrB_2F_8$), barium borofluoride ($BaB_2F_8$), sodium tetrafluoroborate-potassium fluoride ($NaBF_4$—KF), potassium tetrafluoroborate-potassium fluoride ($KBF_4$—KF), lithium tetrafluoroborate ($LiBF_4$), magnesium tetrafluoroborate ($MgBF_4$), strontium borofluoride ($SrB_2F_8$), barium borofluoride ($BaB_2F_8$), or any combination thereof. In some embodiments, the boron fluoride may be a molten salt. For example, sodium tetrafluoroborate, potassium tetrafluoroborate, or potassium fluoride may be in the form of a molten salt.

The boron oxide may be boron trioxide ($B_2O_3$).

The iron boride may be ferrous boride (FeB), iron boride ($Fe_2B$), or any combination thereof.

The boronizing composition may have a melting point of about 350° C., about 400° C., about 450° C., about 500° C., about 550° C., about 600° C., about 650° C., about 700° C., about 750° C., about 800° C., about 850° C., about 900° C., or a range between any of these values (including endpoints). The boronizing composition may have multiple melting points. The boron fluoride may have a different melting point than the boron oxide, borax, or the iron boride. In some embodiments, the boronizing composition may have melting points of 384° C. and 450° C. In other embodiments, the boronizing composition may have melting points of 384° C. and 734° C. In further embodiments, the boronizing composition may have melting points of 530° C. and 734° C. In yet further embodiments, the boronizing composition may have melting points of 384° C. and 858° C. In other embodiments, the boronizing composition may have melting points of 530° C. and 858° C. The melting points of the boronizing composition may also be eutectic points of the composition.

The boronizing composition may have at least 5% by weight of boron fluoride. The boronizing composition may have about 5% by weight of boron fluoride, about 10% by weight of boron fluoride, about 15% by weight of boron fluoride, about 20% by weight of boron fluoride, about 25% by weight of boron fluoride, about 30% by weight of boron fluoride, about 35% by weight of boron fluoride, about 40% by weight of boron fluoride, about 45% by weight of boron fluoride, about 50% by weight of boron fluoride, about 55% by weight of boron fluoride, about 60% by weight of boron fluoride, about 65% by weight of boron fluoride, about 70% by weight of boron fluoride, or a range between any of these values (including endpoints). The boronizing composition may have at least 5% to about 70% boron fluoride by weight.

The boronizing composition may have about 30% by weight of one or more of a boron oxide, borax, or an iron boride. The boronizing composition may have one or more of a boron oxide, borax, or an iron boride at about 35% by weight, about 40% by weight, about 45% by weight, about 50% by weight, about 55% by weight, about 60% by weight, about 65% by weight, about 70% by weight, about 75% by weight, about 80% by weight, about 85% by weight, about 90% by weight, about 95% by weight, or a range between any of these values (including endpoints). The boronizing composition may have about 30% to about 95% by weight of one or more of a boron oxide, borax, or an iron boride.

The boronizing composition may additionally include an activator, a binder, bed material, or any combination thereof. The activator may be potassium tetrafluoroborate, sodium tetrafluoroborate, ammonium tetrafluoroborate, ammonium chloride, sodium carbonate, barium fluoride, borax, or any combination thereof. The binder may be any polymer-based material. For example, the binder may be epoxy resin, acrylate, or any mixture of organic binder and solvents. In some embodiments, the binder amount may be up to 30% by weight of the boronizing composition. For example, the binder amount may be about 1% to about 30% by weight, about 5% to about 25% by weight, about 10% to about 20% by weight, about 10% to about 15% by weight, or a range between any of these values (including endpoints). The bed material may be carbides. For example, the bed material may be silicon carbides. In some embodiments, the bed material may be up to 90% by weight of the boronizing composition. For example, the bed material may be about 1% to about 90% by weight, about 5% to about 80% by weight, about 10% to about 70% by weight, about 15% to about 60% by weight, about 20% to about 50% by weight, about 25% to about 40% by weight, about 30% to about 35% by weight, or a range between any of these values (including endpoints).

A method of boronizing a metal substrate with a boronizing composition is disclosed. The method may be performed in a steel box, an electrical muffle, a pit furnace, or other suitable location. The method may be performed in a vacuum or in a protective atmosphere that may be oxygen deficient. In some embodiments, the protective atmosphere may be an inert environment, for example, a nitrogen environment or an argon environment.

The metal substrate may be a steel, ferrous nickel, a cobalt alloy, a carbide, titanium, a titanium alloy, a molybdenum alloy, or a combination thereof. In some embodiments, the metal substrate may be a steel. In other embodiments, the metal substrate may be 12% Cr modified stainless steel. In further embodiments, the metal substrate may be a 12% Cr steel, such as, AISI 403, 422, X20Cr13, or X22CrMoV12-1. For example, the metal substrate may be a turbine or turbine blades from a steam turbine.

The boronizing composition is as described above and includes at least one boron fluoride, or molten salts thereof, and one or more of a boron oxide, borax, or an iron boride.

The boron fluoride may be lithium tetrafluoroborate ($LiBF_4$), sodium tetrafluoroborate ($NaBF_4$), potassium tetrafluoroborate ($KBF_4$), magnesium tetrafluoroborate ($MgBF_4$), strontium borofluoride ($SrB_2F_8$), barium borofluoride ($BaB_2F_8$), sodium tetrafluoroborate-potassium fluoride ($NaBF_4$—KF), potassium tetrafluoroborate-potassium fluoride ($KBF_4$—KF), lithium tetrafluoroborate ($LiBF_4$), magnesium tetrafluoroborate ($MgBF_4$), strontium borofluoride ($SrB_2F_8$), barium borofluoride ($BaB_2F_8$), or a combination thereof. In some embodiments, the boron fluoride may be a molten salt. For example, sodium tetrafluoroborate, potassium tetrafluoroborate, or potassium fluoride may be in the form of a molten salt.

The boron oxide may be boron trioxide ($B_2O_3$).

The iron boride may be ferrous boride (FeB), iron boride ($Fe_2B$), or any combination thereof.

The boron composition may have a melting point of about 350° C., about 400° C., about 450° C., about 500° C., about 550° C., about 600° C., about 650° C., about 700° C., about 750° C., about 800° C., about 850° C., about 900° C., or a range between any of these values (including endpoints). The boron composition may have multiple melting points. The boron fluoride may have a different melting point than the boron oxide, borax, or the iron boride. In some embodiments, the boron composition may have melting points of 384° C. and 450° C. In other embodiments, the boron composition may have melting points of 384° C. and 734° C. In further embodiments, the boron composition may have melting points of 530° C. and 734° C. In yet further embodiments, the boron composition may have melting points of 384° C. and 858° C. In other embodiments, the boron composition may have melting points of 530° C. and 858° C. The melting points of the boron composition may also be eutectic points of the composition.

The boron composition may have at least 5% by weight of boron fluoride. The boronizing composition may have about 5% by weight of boron fluoride, about 10% by weight of boron fluoride, about 15% by weight of boron fluoride, about 20% by weight of boron fluoride, about 25% by weight of boron fluoride, about 30% by weight of boron fluoride, about 35% by weight of boron fluoride, about 40% by weight of boron fluoride, about 45% by weight of boron fluoride, about 50% by weight of boron fluoride, about 55% by weight of boron fluoride, about 60% by weight of boron fluoride, about 65% by weight of boron fluoride, about 70% by weight of boron fluoride, or a range between any of these values (including endpoints). The boronizing composition may have at least 5% to about 70% boron fluoride by weight.

The boron composition may have about 30% by weight of one or more of a boron oxide, borax, or an iron boride. The boronizing composition may have one or more of a boron oxide, borax, or an iron boride at about 35% by weight, about 40% by weight, about 45% by weight, about 50% by weight, about 55% by weight, about 60% by weight, about 65% by weight, about 70% by weight, about 75% by weight, about 80% by weight, about 85% by weight, about 90% by weight, about 95% by weight, or a range between any of these values (including endpoints). The boronizing composition may have about 30% to about 95% by weight of one or more of a boron oxide, borax, or an iron boride.

The boron composition may additionally include an activator, a binder, bed material, or any combination thereof. The activator may be potassium tetrafluoroborate, sodium tetrafluoroborate, ammonium tetrafluoroborate, ammonium chloride, sodium carbonate, barium fluoride, borax, or any combination thereof. The binder may be any polymer-based material. For example, the binder may be epoxy resin, acrylate, or any mixture of organic binder and solvents. In some embodiments, the binder amount may be up to 30% by weight of the boronizing composition. For example, the binder amount may be about 1% to about 30% by weight, about 5% to about 25% by weight, about 10% to about 20% by weight, about 10% to about 15% by weight, or a range between any of these values (including endpoints). The bed material may be carbides. For example, the bed material may be silicon carbides. In some embodiments, the bed material may be up to 90% by weight of the boronizing composition. For example, the bed material may be about 1% to about 90% by weight, about 5% to about 80% by weight, about 10% to about 70% by weight, about 15% to about 60% by weight, about 20% to about 50% by weight, about 25% to about 40% by weight, about 30% to about 35% by weight, or a range between any of these values (including endpoints).

In some embodiments, a method of boronizing a metal substrate may include contacting a metal substrate with a boron composition including at least one boron fluoride and one or more of a boron oxide, borax, or an iron boride. In some embodiments, the contacting may include at least partially covering at least one surface of the metal substrate. In other embodiments, the contacting may include covering at least one surface of the metal substrate. In further embodiments, the contacting may include the entire surface of the metal substrate. In yet further embodiments, the contacting may include a finite area of the surface of the metal substrate. In some embodiments, the metal substrate may be completely enveloped by or submersed in the boronizing composition. Regardless, a metal substrate-boron composition combination results.

The boron composition and metal substrate combination may be heated to at least 380° C., for at least one hour. The boron composition and metal substrate may be heated to about 350° C., about 400° C., about 450° C., about 500° C., about 550° C., about 600° C., about 650° C., or a range between any of these values (including endpoints).

Although the method may be performed at atmospheric pressure, in some embodiments, the boron composition and metal substrate may be heated while under pressure. For example, the boron composition and metal substrate may be heated while under a pressure of about 100 kPa, about 200 kPa, about 300 kPa, about 400 kPa, about 500 kPa, about 600 kPa, about 700 kPa, about 800 kPa, about 900 kPa, about 1000 kPa, or a range between any of these values (including endpoints).

In some embodiments, the boron composition and metal substrate may be heated, for less than 5 hours. The boron composition and metal substrate may be heated, under pressure, for about 1 hour, about 2 hours, about 3 hours, about 4 hours, about 5 hours, or a range between any of these values (including endpoints).

Optionally, the method may include applying an electric current simultaneously while heating the boron composition and metal substrate. The application of an electric current may increase the rate of interaction of the boron composition with the metal substrate. In some embodiments, the electric current may be about 0.1 $mA/mm^2$, about 0.2 $mA/mm^2$, about 0.4 $mA/mm^2$, about 0.6 $mA/mm^2$, about 0.8 $mA/mm^2$, 1.0 $mA/mm^2$, about 1.2 $mA/mm^2$, about 1.4 $mA/mm^2$, about 1.6 $mA/mm^2$, about 1.8 $mA/mm^2$, about 2.0 $mA/mm^2$, or a range between any of these values (including endpoints). The electrical current may increase the mobility of ions in the boron compounds. The increase in the mobility of ions may increase the rate of interaction of the boron composition with the metal substrate and may reduce the heating time.

In some embodiments, the electric current may be applied using Spark Plasma Sintering (SPS) technology. The SPS technology is a modified hot pressing process where a pulsed electrical current flows directly through the metal substrate. The pulsed electrical current causes a very fast melting and sintering of materials with suppressed grain growth. The SPS technology is applied while under high pressure and reduces the boronization process time.

During the process, the boron composition may interact with the metal substrate, whereby a boron layer is created. Diffusion of boron ions to the metal substrate surface and reaction of boron ions with the metal substrate results in a boron layer, such as, iron boron of iron boride. The boron layer has increased hardness and creates a protective boron layer at the surface of the metal substrate. In some embodiments, the boron layer may be iron boron for steel substrates. In some embodiments, the boron layer may have a thickness of at least 40 micrometers. The boron layer may have a thickness of about 40 micrometers, about 50 micrometers, about 60 micrometers, about 70 micrometers, about 80 micrometers, about 90 micrometers, about 100 micrometers, or a range between any of these values (including endpoints).

The method of boronizing a metal substrate with the use of the boronizing compositions may be used for surface treatment of steels in steam turbine components. For example, blades, nozzles, rotors, casings, valves, steam pipes, and bearings of steam turbines may be surface treated. The method may be used with other boronizing techniques. For example, pack cementation and paste/slurry boronizing techniques may be used with the boronizing compositions disclosed herein.

EXAMPLES

Various aspects of the present invention will be illustrated with reference to the following non-limiting examples. The following examples are for illustrative purposes only and are not to be construed as limiting the invention in any manner.

Example 1: Boronizing Compositions

The following Boronizing compositions will be made as described above:

| | Component A: Boron Fluoride | | Component B: Boron Oxide, Borax, Or An Iron Boride | |
|---|---|---|---|---|
| Example | Compound | % by wt. | Compound | % by wt. |
| 1a | $NaBF_4$ | 10 | $B_2O_3$ | 90 |
| 1b | $NaBF_4$ | 20 | $Na_2B_4O_7$ (Borax) | 80 |
| 1c | $KBF_4$ | 30 | $Na_2B_4O_7$ (Borax) | 70 |
| 1d | $NaBF_4$-KF | 30 | FeB | 70 |
| 1e | $KBF_4$4-KF | 40 | FeB | 60 |

In Example 1, boronizing compositions were made in accordance with the table above.

In each case, the desired amount of Component A (Boron Fluoride compound) will be mixed with the desired amount of Component B to yield a boronizing compound. Mixing will be accomplished by stirring.

Example 2: Method of Boronizing a Metal Substrate

A method of boronizing a 12% Cr modified stainless steel substrate will be boronized in a pit furnace filled with Nitrogen atmosphere. A pack cementation boronizing technique will be used. A boronizing compound, such as those prepared in Example 1 (for example, Example 1d sodium tetrafluoroborate-potassium tetrafluoroborate and iron boride ($NaBF_4$—KF and FeB)). The stainless steel substrate will be completely packed. The stainless steel substrate will be contacted with the boronizing compound and will be heated to 400° C. for 5 hours in a pit furnace. The boronizing compound will be permitted to interact with the stainless steel substrate to create a 50 μm boron layer on the surface of the stainless steel substrate. The boronized stainless steel will be used for Tri-pin blades in a steam turbine.

Example 3: Method of Boronizing a Metal Substrate with Spark Plasma Sintering Technology A method of boronizing a 12% Cr modified stainless steel, AISI 403, will be boronized in an electrical muffle. A boronizing technique with a Spark Plasma Sintering process will be used. The boronizing compound will be sodium tetrafluoroborate and boron oxide (Example 1a: $NaBF_4$ and $B_2O_3$). The stainless steel will be contacted with the boronizing compound and will be heated to 450° C., under vacuum, for 4 hours in a Spark Plasma Sintering chamber. A pulsed electrical current will be applied for heating of the boronizing compound and the stainless steel. The pulsed electrical current will flow directly through the boronizing compound and the stainless steel. The boronizing compound will interact with the stainless steel to create a 60 μm boron layer on the stainless steel. The boronized stainless steel will be used for nozzle block vanes in a steam turbine.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera As a non-limiting example, each range discussed herein can be readily broken down into a lower third, middle third and upper third, et cetera As will also be understood by one skilled in the art all language such as "up to," "at least," and the like include the number recited and refer to ranges which can be subsequently broken down into subranges as discussed above. Finally, as will be understood by one skilled in the art, a range includes each individual member.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

Although the present invention has been described in considerable detail with reference to certain preferred embodiments thereof, other versions are possible. Therefore, the spirit and scope of the appended claims should not be limited to the description and the preferred versions contained within this specification.

What is claimed is:

1. A boronizing composition comprising:
at least 5% by weight of the composition of at least one boron fluoride, or molten salts thereof: and
at least 30% by weight of the composition of one or more of a boron oxide, borax or an iron boride;
wherein the one or more of boron oxide, borax or iron boride is FeB or $Fe_2B$.

2. The boronizing composition of claim 1, wherein the boron oxide is B2O3.

3. The composition of claim 1, wherein the melting point and eutectic point of the composition is less than 900° C.

4. The composition of claim 1, further comprising an activator, binder, or bed materials.

5. The composition of claim 4, wherein the activator is selected from the group consisting of potassium tetrafluoroborate, sodium tetrafluoroborate, ammonium tetrafluoroborate, ammonium chloride, sodium carbonate, barium fluoride, borax, or a combination thereof.

6. The composition of claim 4, wherein the bed material is a carbide.

7. The boronizing composition of claim 1, wherein the boron fluoride is NaBF4.

8. The boronizing composition of claim 1, wherein the boron fluoride is KBF4.

9. A boronizing composition comprising:
at least 5% by weight of the composition of at least one boron fluoride, or molten salts thereof: and
at least 30% by weight of the composition of one or more of a boron oxide, borax or an iron boride;
wherein the boron fluoride is NaBF4-KF; and
the at least one of boron oxide, borax, or iron boride is FeB.

10. A boronizing composition comprising:
at least 5% by weight of the composition of at least one boron fluoride, or molten salts thereof: and
at least 30% by weight of the composition of one or more of a boron oxide, borax or an iron boride;
wherein the boron fluoride is KBF4-KF; and
the at least one of boron oxide, borax, or iron boride is FeB.

* * * * *